US007486920B2

(12) United States Patent
Schmidt

(10) Patent No.: US 7,486,920 B2
(45) Date of Patent: Feb. 3, 2009

(54) METHOD AND DEVICE ELECTRICALLY DISCHARGING A PRINTING MATERIAL

(75) Inventor: Soenke Schmidt, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 147 days.

(21) Appl. No.: 10/593,402

(22) PCT Filed: Mar. 15, 2005

(86) PCT No.: PCT/EP2005/002739

§ 371 (c)(1),
(2), (4) Date: Sep. 20, 2006

(87) PCT Pub. No.: WO2005/091083

PCT Pub. Date: Sep. 29, 2005

(65) Prior Publication Data

US 2007/0189816 A1 Aug. 16, 2007

(30) Foreign Application Priority Data

Mar. 20, 2004 (DE) ..... 10 2004 013 771

(51) Int. Cl.
*G03G 15/16* (2006.01)

(52) U.S. Cl. ..... 399/315

(58) Field of Classification Search ..... 399/45, 399/315; 361/213, 214
See application file for complete search history.

(56) References Cited

U.S. PATENT DOCUMENTS

| | | | |
|---|---|---|---|
| 4,027,201 A | 5/1977 | Bacon et al. | |
| 5,121,285 A | 6/1992 | McClure et al. | |
| 6,173,150 B1 * | 1/2001 | Suzuki et al. | 399/315 |

FOREIGN PATENT DOCUMENTS

| | | |
|---|---|---|
| JP | 62 032479 | 2/1987 |
| JP | 08 022204 | 1/1996 |
| JP | 08022204 | 1/1998 |

* cited by examiner

*Primary Examiner*—Sandra L Brase

(57) ABSTRACT

A method and a device to electrostatically discharge a printing material, to which a toner has been applied, in an appropriate manner. The method is provided for electrically discharging certain areas of a toner-coated printing material, in particular for an electrophotographic printing machine. The discharge device is provided for a printing machine, specifically for an electrophotographic printing machine, for electrically discharging toner-coated printing material. The device uses a control device for electrically discharging certain areas of the printing material.

6 Claims, 2 Drawing Sheets

METHOD AND DEVICE ELECTRICALLY DISCHARGING A PRINTING MATERIAL

The present invention relates to a method and a discharge device for electrically discharging a printing material to which toner has been applied.

In printing processes which do not use printing plates, i.e., the so-called non-impact printing processes, specifically in electrophotographic and ionographic printing processes, latent electrostatic images are applied to an imaging cylinder. Toner is applied to these latent images, and they are transferred directly from the imaging cylinder, or indirectly via an intermediate cylinder, to a printing material. In order to facilitate the transfer of the toner-coated electrostatic image from the imaging cylinder or the intermediate cylinder to the printing material, an electrical charge device such as a corotron, for example, is provided at a transport belt used for transporting the printing material, said device electrostatically charging the printing material. Following the transfer of the toner image, a discharge device is used to remove the electrostatic charges from the printing material, because such charges could impair the depositing of the printing material on a stack. However, until now, discharging of the printing material has not been accomplished in a satisfactory manner.

An object of the invention is to discharge a printing material, to which a toner has been applied, in an appropriate manner.

In accordance with the present invention, a method for electrically discharging toner-coated printing material, in particular for an electrophotographic printing machine, is provided, in which case certain areas of the printing material are electrically discharged.

Furthermore, a discharge device for a printing machine, specifically for an electrophotographic printing machine, is provided for electrically discharging toner-coated printing material, said device using a control device for electrically discharging certain areas of the printing material.

Following is a detailed description of embodiments of the invention, reference being made to drawings.

They show in

Figure 1:
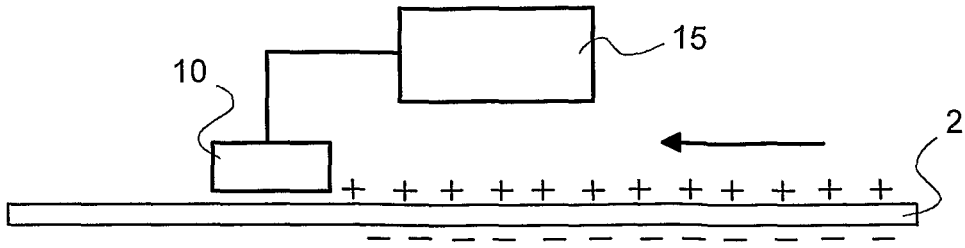
Figure 2:
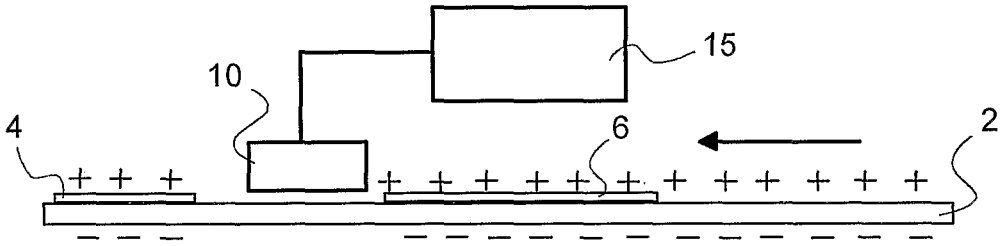
Figure 3:
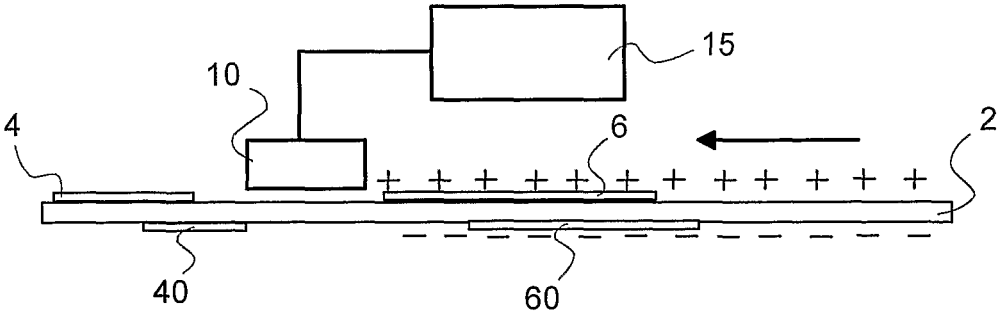
Figure 4:
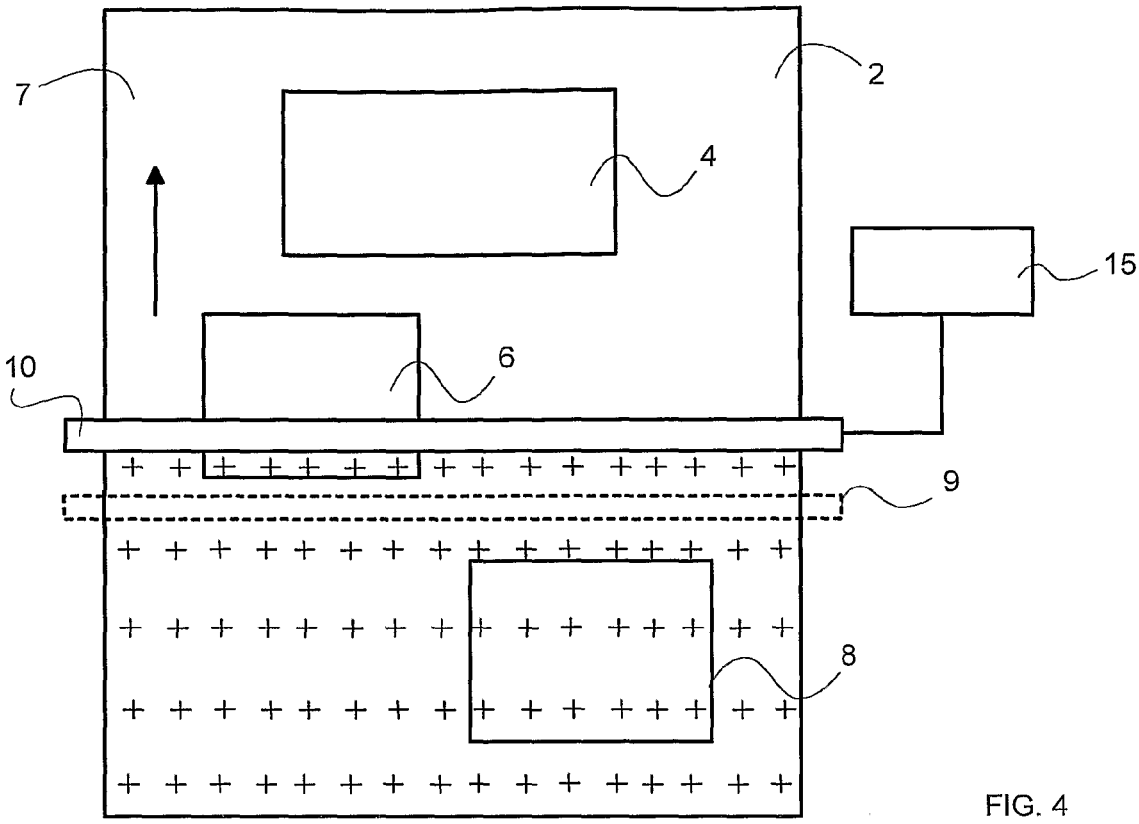
Figure 5:
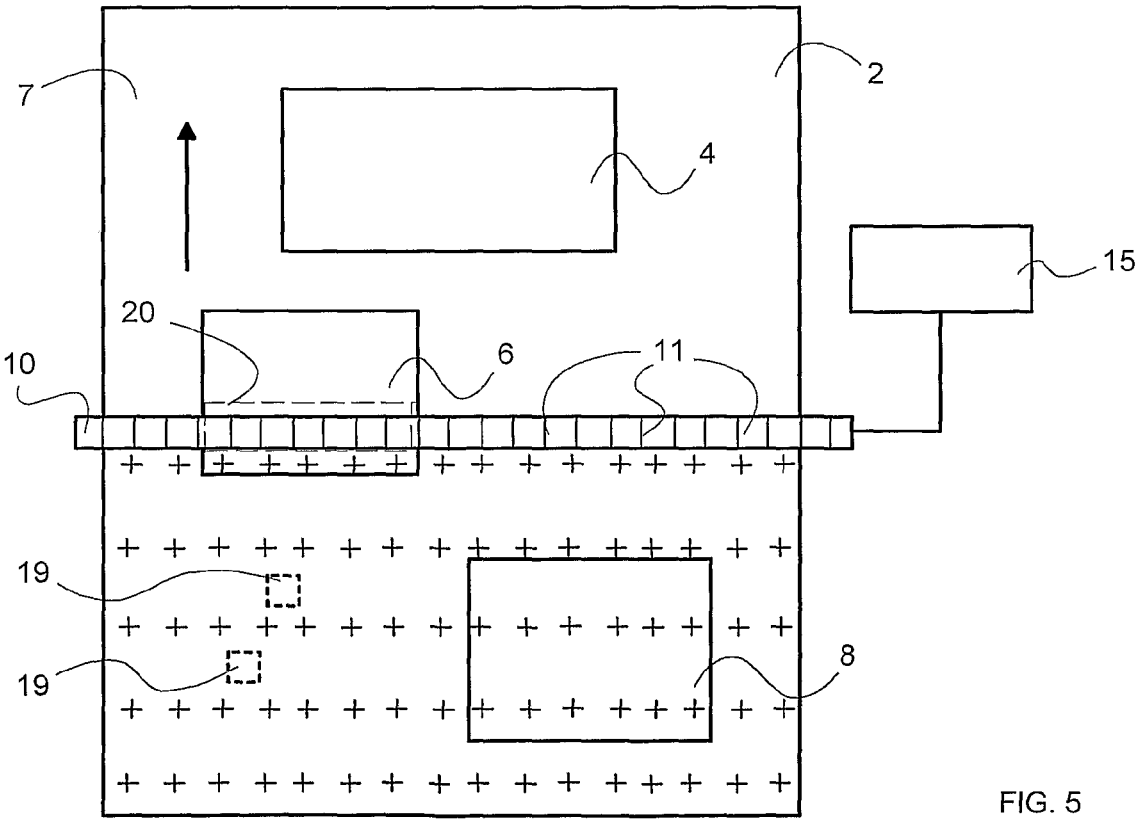

FIG. 1 a schematic side elevation of an electrostatically charged printing material, depicting a discharge device for removing electrostatic charges;

FIG. 2 an illustration similar to that of FIG. 1, depicting an electrostatically charged printing material with toner-coated areas displaying a high toner density on the printing material surface;

FIG. 3 an illustration similar to that of FIG. 2, depicting toner-coated areas displaying a high toner density on the upper side and on the underside of the printing material;

FIG. 4 a schematic plan view of the electrically charged printing material in accordance with FIG. 2; and, FIG. 5 a schematic plan view of the electrophotographically charged printing material with individually energizable discharge areas on the discharge device.

FIG. 1 depicts a schematic side elevation of an electrostatically charged printing material 2, which is transported in the usual manner on a transport belt through a printing machine in the direction indicated by the arrow. The present example shows a printing machine, which operates on the basis of the principle of electrostatic printing. Electrostatic charges, which are applied to printing material 2 by a charge device, are indicated schematically by plus signs on the upper side and by minus signs on the underside of printing material 2. The electrical charge of printing material 2 substantially supports the transfer of the electrically charged toner image to printing material 2. A difference of potential exists between the positively charged upper side and the negatively charged underside of printing material 2. A certain charge compensation due to a charge transport takes place between the two sides of printing material 2. Printing material 2 displays relatively good conductivity, whereas a toner displays relatively poor conductivity. In order to aid the discharge of printing material 2, i.e., an equalization of the oppositely charged sides of printing material 2, a discharge device 10 connected with control device 15 of the printing machine is provided in close proximity of printing material 2. Discharge device 10, for example, comprises electrically conductive wires through which an electrical current is directed when control device 15 is to be energized and about which an electromagnetic field is created, said magnetic field acting on printing material 2 and substantially effecting a discharge of printing material 2. In this example, discharge device 10 is located above printing material 2; alternatively, said device can be located below or on both sides of printing material 2. As a result of the electrical discharge of printing material 2 by means of discharge device 10, there are substantially no electrical charges on printing material 2 downstream of discharge device 10, viewed in transport direction.

FIG. 2 shows an illustration similar to that of FIG. 1, comprising an electrostatically charged printing material 2 with certain toner-coated surface areas and with toner areas 4, 6, 8, in which toner has been applied to printing material 2, said toner being depicted as being raised. Toner areas 4, 6, 8 have a higher toner density than the remaining areas 7 of printing material 2. Thus, in order to illustrate the problem an incomplete discharge of printing material 2 is shown, toner areas 4, 6, 8 display electrical charges even after having been discharged by means of discharge device 10, in which case areas 7 of printing material 2, to which toner has not been applied or which display low toner density, are substantially discharged. This situation can be explained in that the charge transport through the toner is less effective in toner areas 4, 6, 8 than on tonerless printing material 2. The toner exhibits a poorer conductivity than printing material 2, i.e., the discharge operation poses a greater problem with toner than with printing material 2. Consequently, discharge device 10 removes electrical charges in the areas 7 on the upper side and underside of printing material 2, whereas the charges on the underside of printing material 2 opposite toner areas on the upper side of printing material 2, as well as toner areas 4, 6, 8, display electrical charges even after having been discharged. Consequently, electrical charges, which are not removed by discharge device 10, can have a negative effect during subsequent printing steps. For example, undesirable electrical charges disrupt the depositing of printing material 2 in a tray of the printing machine; i.e., printing material 2 is corrugated, or sheets of printing material 2 adhere to each other. Therefore, it is desirable to remove substantially all electrical charges from printing material 2, i.e., in areas 7 having no toner or low toner density, as well as in areas having high toner density, namely toner areas 4, 6, 8.

FIG. 3 is a schematic view of a printing material 2 with toner areas 4, 6, 8 having high toner density on the upper side of printing material 2 and with toner areas 40, 60 having high toner density on the underside of printing material 2. The toner density in toner areas 4, 6, 8, 40, 60 is relatively high. in comparison with that of the remaining areas 7 of printing material 2. Discharge device 10, controlled by control device 15, performs a discharge in certain areas of printing material 2 as a function of the toner densities on both sides of printing material 2. Discharge device 10 is adjusted in such a manner that printing material 2 is discharged with the proper discharge energy as a function of toner density. In this example, the electrical discharge of printing material 2 is performed on both sides of printing material 2, depending on toner density. Control device 15 contains data relating to the areas to be discharged as a function of the toner density in toner areas 4, 6, 8, 40, 60 on both sides, said data being used to energize discharge device 10. If, at a given time during discharge, toner areas 4, 6, 8, 40, 60 are present on both sides of printing material 2, the toner densities of toner areas 4, 6, 8 of one side are added to the toner densities of toner areas 40, 60 on the other side. In control device 15, the toner densities resulting from this addition are assigned to an energizing value, which energizes discharge device 10 with a correspondingly higher discharge energy than would be the case in simplex-printing with a single toner area 4, 6, 8, 40, 60. In this manner, a suitable electrical discharge of printing material 2 is achieved in areas of simplex printing, as well as of duplex printing with toner areas 4, 6, 8, 40, 60 on both sides of printing material 2.

FIG. 4 shows a plan view of a sheet of printing material 2 of an embodiment of the invention, in which case printing material 2 is provided with toner in individual areas, i.e., toner areas 4, 6, 8, during a printing operation and displays in these areas a high toner density compared with the remaining areas 7. Toner areas 4, 6, 8, for example, represent polychromatic images which are composed of several layers of toner having different colors. The thickness of toner areas 4, 6, 8 results form the sum of the individual thicknesses of the colors used. The remaining areas 7 of the sheet of printing material 2 are essentially not provided with toner or they display a lower toner density, for example, they are provided with text. Printing material 2 is transported through the printing machine in the direction of the arrow. Discharge device 10 is located above printing material 2, said discharge device being connected with control device 15. Controlled by control device 15, discharge device 10 electrically discharges certain areas of printing material 2. In the present example of FIG. 4, respectively one strip 9 of printing material 2 corresponding approximately to the width of discharge device 10 is discharged individually by control device 15. The printing material is divided into a series of strips 9 which extend from one longitudinal side to the opposite longitudinal side. Strips 9 have a width of, for example, one to two centimeters and extend over the entire length of printing material 2. As an example, one strip 9 is shown schematically in dashed lines. Discharge device 10 is adjusted in such a manner that each of the individual strips 9 is discharged respectively with an appropriate discharge energy as a function of the toner density intrinsic in this strip 9. Before discharging, the toner density of each strip 9 of printing material 2 is defined for this purpose, said density being high in toner areas 4, 6, 8. The toner density is determined in accordance with the printing data of the current printing job, so that an energizing value is available to control device 15 for each strip 9 of printing material 2 that is to be discharged, said control device appropriately discharging strip 9. In conjunction with this, care must be taken that the energizing value of discharge device 10 is applied at the time when the respective strip 9 of printing material 2 is positioned below discharge device 10. This timing can be determined by means of the transport speed of printing material 2. Preferably, the electrical discharge from discharge device 10 occurs at an AC voltage and at a DC voltage. The AC voltage used for discharge remains constant; the DC voltage is varied as described; the offset of the DC voltage changes as a function of toner density in the currently to be discharged strip 9 for each strip 9 of printing material 2, which is passed below discharge device 10. As a result, printing material 2 is discharged as a function of the respective toner density. Therefore, downstream of discharge device 10, viewed in transport direction, printing material 2 is substantially free of electrical charges.

FIG. 5 shows another inventive embodiment similar to that in FIG. 4, with a sheet of printing material 2, which is transported through the printing machine in the direction of the arrow. Printing material 2 displays, in some areas framed by a rectangle, a high toner density, i.e. in toner areas 4 ,6, 8. The remaining, not identified, areas 7 on the surface of printing material 2 display a low toner density. In this example, discharge device 10 is divided into a number of discharge areas 11, which can be. energized individually by control device 15. Individual discharge areas 11 of discharge device 10 extend substantially across the entire length of discharge device 10, i.e., at least across the width of the electrostatically charged printing material 2. By means of printing data of the current print job, the toner density is determined for each area 19 of printing material 2. In this example, the areas 19 correspond approximately to the size of discharge areas 11 of discharge device 10 and have approximately the width and approximately the length of discharge device 10. Printing material 2 is divided into a number of adjoining areas 19, which are used to determine the toner density and an appropriate energizing value for discharge device 10. As an example, two areas 19 are framed in dashed lines. Considering each area 19 on printing material 2, which is transported through the printing machine, control device 15 contains data regarding the toner density of area 19. When the electrostatically charged printing material 2 is discharged, discharge device 10 is energized by control device 15 in such a manner that individual discharge areas 11 of discharge device 10 display a different discharge energy as a function of the changing toner density on printing material 2. The higher the toner density is in the defined area 19 on printing material 2, the higher the discharge energy of the corresponding partial area 11 of discharge device 10 becomes, whereby said partial area 11 discharges the defined area 19 of printing material 2. In the example of FIG. 5, discharge areas 11 of discharge device 10, which are framed by dashed-line frame 20 and, in a given moment, discharge toner area 6 having high toner density, are energized with higher discharge values than the remaining discharge areas 11 of discharge device 10. Toner area 6 is discharged appropriately; in this case, areas 7 of printing material 2 having low toner density, which are discharged in the same moment by the remaining discharge areas 11 of discharge device 10, are not discharged with an increased discharge energy. During the continued transport of printing material 2, discharge areas 11 above toner area 6 framed by dashed-line frame 20 are energized with higher values by control device 15, until toner area 6 is no longer under discharge device 10. Then, a section of printing material 2 having low toner density is discharged in area 7 of printing material 2 between toner area 6 and toner area 8, in which case all discharge areas 11 are energized substantially with the same discharge values, and a uniform discharge along areas 19 occurs from one longitudinal side to the opposite. longitudinal side of printing material 2. Next, during the transport of printing material 2, toner area 8 moves into the region of influence of discharge device 10, where discharge areas 11 which discharge toner area 8 and are located above said toner area, are energized with higher discharge values than when discharge occurs in the areas of low toner density outside the framed toner area 8. By discharging printing material 2 in discharge areas 11 by means of discharge device 10, individual areas 19 of printing material 2 are always appropriately discharged, and discharge device 10 provides, at any time, for each area 19 of printing material 2, the desired discharge energy corresponding to the toner density. The size and form of areas 19 to be discharged can be selected as desired, depending on the design of discharge device 10.

The invention claimed is:

1. A method for electrically discharging a printing material to which toner has been applied, in particular for an electrophotographic printing machine, the printing material having toner areas displaying higher toner densities than in other areas of the printing material displaying lower toner densities, an electrical discharge energy being provided by a discharge device and being adjusted as a function of the toner density to be applied on respectively individual strips of a series of strips dividing the printing material on the upper side and/or the underside of said printing material, one strip corresponding approximately to the width of the discharge device and extending from one longitudinal side to the opposite longitudinal side of the printing material.

2. The method according to claim 1, wherein the printing material is electrically discharged by the discharge device in a direction transverse to the transport direction of the printing material.

3. The method according to claim 1, wherein the toner discharge device electrically discharges areas displaying high toner densities and areas of the printing material displaying low toner densities by means of individually energizable discharge areas extending substantially across the entire length of the discharge device, each dischargeable area of the printing material having approximately the size of said individual energizable discharge area.

4. A discharge device for a printing machine, in particular for an electrophotographic printing machine, for electrically discharging a printing material to which toner has been applied on toner areas displaying higher toner densities than in other areas of the printing material displaying lower toner densities, the discharge device comprising a control device for electrically discharging individual strips of a series of strips dividing the printing material, the width of the discharge device corresponding approximately to one individual strip of said series of strips dividing the printing material, and the discharge device extending at least across the width of the printing material.

5. The discharge device for a printing machine according to claim 4, wherein said discharge device is divided into a number of discharge areas individually energizable by the control device, said individual discharge areas extending substantially across the entire length of the discharge device.

6. The discharge device for a printing machine according to claim 4, wherein said discharge device comprises a discharge unit for electrically discharging the printing material (2) with AC voltage and DC voltage.

* * * * *